US005987053A

United States Patent [19]

Webb

[11] Patent Number: 5,987,053

[45] Date of Patent: Nov. 16, 1999

[54] HIGH TEMPERATURE AIR COOLED VACUUM FURNACE

[76] Inventor: Richard Dyson Webb, 303 Worcester St., Wellesley, Mass. 02181

[21] Appl. No.: 08/922,275

[22] Filed: Sep. 3, 1997

[51] Int. Cl.[6] ..... F27D 1/00

[52] U.S. Cl. ..... 373/137; 373/110

[58] Field of Search ..... 373/109, 110, 373/111, 112, 113, 118, 136, 116, 130, 135, 137; 432/176, 146, 5, 21, 77, 205, 250, 152; 219/385–400; 266/251, 259

[56] References Cited

U.S. PATENT DOCUMENTS

| | | | |
|---|---|---|---|
| 3,571,478 | 3/1971 | Teagan | 13/31 |
| 3,644,655 | 2/1972 | Vollmer | 13/31 |
| 4,278,421 | 7/1981 | Limque et al. | 432/152 |
| 4,430,055 | 2/1984 | Sugiyama | 432/11 |
| 4,854,863 | 8/1989 | Hemsath | 432/176 |
| 4,886,449 | 12/1989 | Brittin | 432/121 |
| 5,267,257 | 11/1993 | Jhawar et al. | 373/110 |

*Primary Examiner*—Tu Ba Hoang
*Attorney, Agent, or Firm*—Dennison, Meserole, Scheiner & Schultz

[57] ABSTRACT

A high temperature vacuum furnace which has an internal thermal insulation system to reduce heat losses and an external vacuum vessel which is designed to safely dissipate all heat generated within the furnace to the surrounding air. The vacuum vessel wall remains at a low enough temperature to ensure structural integrity and at a low enough temperature to protect elastomer seals without the use of water cooling.

3 Claims, 1 Drawing Sheet

HIGH TEMPERATURE AIR COOLED VACUUM FURNACE

BACKGROUND—FIELD OF THE INVENTION

This invention relates to the construction of an electrically heated vacuum furnace capable of reaching high temperatures on the order of 1500° K to 3000° K without the use of cooling water to protect the vacuum vessel. More specifically, the invention concerns the design of the vacuum vessel and the thermal insulation system, the thermal insulation system being designed to minimize heat transfer to the vacuum vessel, the vacuum vessel being designed to safely transfer all of this heat to the ambient air surrounding the vacuum vessel.

BACKGROUND—DESCRIPTION OF THE RELATED ART

Vacuum furnaces have been commonly used in high temperature thermal treatment of materials requiring a high level of purity. A typical vacuum furnace consists of a gas tight vacuum chamber inside of which is a heated zone having one or more electrically heated elements, this heated zone being surrounded by thermal insulation to reduce power consumption and improve temperature uniformity.

We note that vacuum furnaces are typically capable of operating both under vacuum and with inert or reactive gas protective atmospheres. In the case of very high temperature vacuum furnaces operating at temperatures on the order of 2500° K or higher, an inert gas atmosphere is desirable to reduce sublimation of the heating elements and insulation materials, thereby prolonging the useful life of these critical components. Protective atmospheres are also desired in many cases to reduce sublimation of the materials being thermally treated in the furnace.

Reactive gases such as hydrogen or nitrogen are also introduced to vacuum furnaces on occasion to initiate desirable gas-solid interactions, such as the reduction of metal oxides or the nitridation of metals. In most of these processes, vacuum is used at the beginning of the process to remove ambient air, thereby insuring purity of the processing atmospheres, and often during the initial stages of heating to remove outgassed contaminants. When referring to vacuum furnaces in this discussion we are therefore referring to both those furnaces whose principal mode of operation is under vacuum, and those furnaces for which vacuum operation is an auxiliary mode.

The vacuum chamber for these furnaces normally has at least one door or port large enough for insertion and removal of the material requiring thermal treatment. This door as well as other ports on the vacuum vessel are commonly sealed with elastomers which provide a convenient, reusable seal which isolates the interior of the chamber from the chamber exterior, thereby allowing removal of more than 99.9% of the air from the vacuum vessel during evacuation.

Elastomers which are readily available at low cost are limited in use to temperatures below 700° K, and if long useful lifetimes are desired, to temperatures below 500° K to 600° K. In the typical vacuum furnace design, the sealing surfaces of the vacuum vessel are maintained at temperatures below 400° K through the use of water cooling.

Water cooling is also used to reduce the temperature of other portions of the vacuum vessel, in addition to the sealing surfaces. When evacuated, the vacuum vessel is subjected to high forces created by the pressure differential between the inside and the outside of the vacuum vessel.

This pressure differential, 14.7 pounds per square inch at normal atmospheric pressure, results in many tons of force acting to crush the vessel. When a common double wall, water jacketed design is employed, this pressure differential can be two or three times higher because of the added pressure needed to force water through the cooling jacket.

Vacuum vessels can be readily designed by those skilled in the art which can withstand these forces for a relatively cool vessel. Steel, stainless steel, aluminum, glass, and plastic vacuum vessels are in common use. However, all of these common engineering materials rapidly decrease in strength as their temperature is increased. Water cooling is used to maintain the vessel wall material at a safe operating temperature, as discussed for example in U.S. Pat. No. 3,644,655 (Vollmer).

U.S. Pat. No. 3,571,478 (Teagan) teaches a way to reduce furnace heat loss through the use of a novel radiation shield pack. This radiation shield pack achieves high thermal efficiency by using a spiral coil of thin metal foil. Use of thin metal foil as taught in this patent can result in a shield pack with five to ten times more shields as compared to standard designs. U.S. Pat. No. 3,571,478 teaches that a laboratory size furnace can reach temperatures in excess of 2300° K with less than 2 kW of power using this type of insulation pack.

Teagan teaches that a conventional glass bell jar can be used as a vacuum chamber with his invention. The bell jar does not overheat in this case because the transparent glass readily transmits the radiant energy produced within the furnace to the outside environment. The key to the utility of the bell jar lies in its ability to transmit rather than absorb radiant energy, rather than on its size or surface area. This mode of heat transfer is limited to transparent materials such as glass, and is also limited to relatively short duration heating cycles because of deposits produced by the furnace which eventually cloud the inside surface of the glass.

Teagan's complex shield pack arrangement has been used successfully to reduce heat losses from small nuclear power sources in space satellites and in similar applications where minimizing weight and size is of critical importance. However, this technology has seen limited commercial success in the vacuum furnace industry because of high fabrication costs.

BRIEF SUMMARY OF THE INVENTION

To address the shortcomings of the prior art, the present invention provides for a high temperature vacuum furnace which does not require water cooling and which uses an efficient insulation pack. The insulation pack thickness and composition is selected to minimize thermal flow through the insulation. Insulation penetrations for thermal sensors, work supports, and power feedthroughs are also designed to reduce heat losses from these sources. Finally, the vacuum chamber is designed with sufficient surface area so that it can safely transfer all heat losses from the furnace to the ambient air surrounding the chamber while the chamber itself remains at a low enough temperature to ensure adequate retention of mechanical strength and long life for elastomeric seals.

Accordingly, several objects and advantages of my invention are:

(a) to provide a high temperature vacuum furnace which does not require water cooling;

(b) to provide a high temperature vacuum furnace which can operate with very low electrical power inputs;

(c) to provide a high temperature vacuum furnace which can be constructed simply and inexpensively (d) to provide a high temperature vacuum furnace which can be quickly and easily installed by unskilled users;

(e) to provide a high temperature vacuum furnace which has greatly reduced operating expenses due to the complete elimination of water consumption and/or water chilling as well as a large reduction in electrical energy consumption;

(f) to provide a high temperature vacuum furnace which has a long life vacuum chamber which is not subjected to the ravages of corrosion and scaling caused by cooling water;

(g) to provide a high temperature vacuum furnace which has improved temperature uniformity in the work zone due to reduced heat flows through the insulation pack.

Other objects and advantages are obtained when my invention is used in the specific case of a small laboratory furnace, as opposed to the more general case of large furnaces, for which my invention is also useful. In the case of small laboratory furnaces, the elimination of cooling water; simplification of vacuum vessel construction; elimination of water manifolds, water hoses, water flow switches, and water valves all combine to result in a high temperature vacuum furnace which weighs less than 40 kg and consumes only 1 kW of electrical power at 2500° K. The power control cabinet for this laboratory furnace is also greatly simplified, weighing less than 30 kg including the transformer and silicon controlled rectifier power controller. These simplified high temperature vacuum furnaces can be easily placed on a benchtop or desktop, plugged into a standard 120 volt wall outlet, and immediately operated. This avoids the extensive and expensive facility modifications needed for traditional high power, water cooled vacuum furnaces. Still further objects and advantages will become apparent from a consideration of the ensuing description and drawing.

BRIEF DESCRIPTION OF THE DRAWING

An example of a furnace constructed in accordance with the present invention will now be described with reference to the accompanying drawing.

Figure 1:
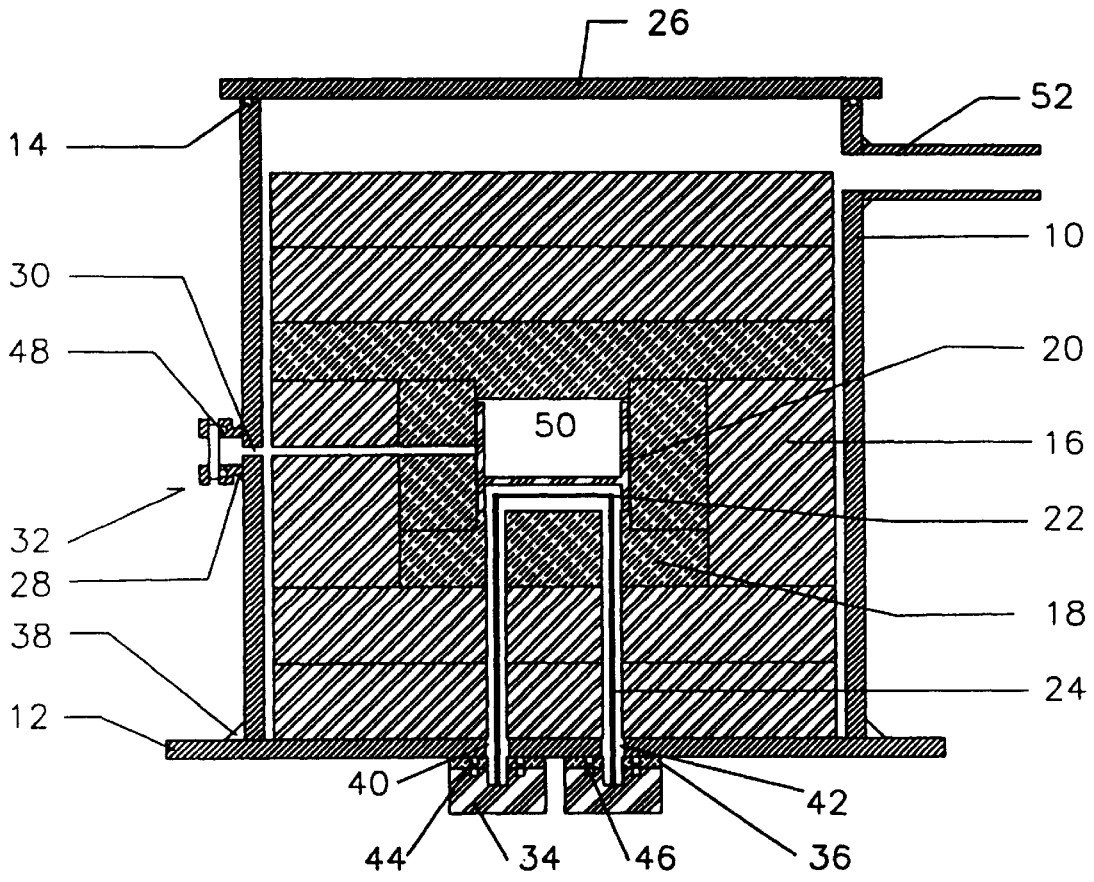
FIG. 1 is a diagrammatic cross-section through an example of a vacuum furnace.

10 chamber sidewall
12 bottom plate
14 door seal
16 low temp insulation
18 high temp insulation
20 graphite retort
22 heating element
24 power buss rods
26 top door
28 hermetic side weld
30 sensor penetration
32 sight window assembly
34 power feedthroughs
36 feedthrough insulators
38 hermetic base weld
40 left feedthrough port
42 right feedthrough port
44 insulator elastomers
46 feedthrough elastomers
48 window elastomer
50 work zone
52 vacuum port

DETAILED DESCRIPTION OF THE INVENTION

A typical embodiment of the present invention is illustrated in FIG. 1. The vacuum chamber sidewall 10 can be of cylindrical, rectangular, or irregular shape, but a cylindrical configuration is often advantageous for ease of fabrication. The bottom plate 12 is shown here permanently attached to the sidewall 10 with a hermetic base weld 38, an appropriate attachment method in this example where the chamber sidewall 10 and bottom plate 12 are both made of aluminum metal.

The removable top door 26 is sealed to the chamber sidewall 10 with a viton elastomer door seal 14. Viton is a common elastomer known to be suitable for prolonged use at temperatures of 500° K and higher.

Additional penetrations are provided in the bottom plate for the left feedthrough port 40 and right feedthrough port 42. These penetrations are sealed to the Teflon power feedthrough insulators 36 with viton insulator elastomers 44. The copper power feedthroughs 34 are sealed to the feedthrough insulators 36 with viton feedthrough elastomers 46.

Although the furnace can be operated without temperature sensors by monitoring power input to the power feedthroughs 34, FIG. 1 shows the more common approach of providing an additional sensor penetration 30 which can be used for inserting a thermocouple temperature sensor or for observing the work zone with an optical or infrared pyrometer. In this case a sight window assembly 32 is sealed with a hermetic side weld 28 to the chamber sidewall 10. The sight window assembly includes a viton window elastomer 48 so that the window can be easily removed for cleaning or replacement. A vacuum port 52 provides a means for removing air, introducing process gases, and sampling the internal chamber atmosphere.

The heating element 22 is shown here as being an integral part of the power buss rods 24 which transfer electrical power from the power feedthroughs 34 to the heating element 22. This integral construction can be achieved by fabricating the element/buss assembly from graphite fibers formed into the desired shape and rigidized with an organic compound such as phenolic. The rigidized element/buss preform is then converted into a carbon fiber, carbon matrix (carbon/carbon) heating element through processes well known to those skilled in the art of manufacturing carbon/carbon heating elements.

Alternately, the heating element 22 can be fabricated separately from the power buss rods 24. Furnace engineers skilled in the art can readily design a graphite or carbon/carbon heating element with the desired electrical resistance to provide the needed power output. The heating element 22 can then be attached to the graphite or carbon/carbon buss rods 24 with graphite or carbon/carbon nuts; graphite cement; and/or refractory metal or graphite pins. The attachment of graphite heating elements to graphite power buss rods requires techniques readily known to those skilled in the art of furnace design.

Fibrous graphite high temperature insulation 18 surrounds the heating element 22 and defines a useable work zone 50. A dense graphite retort 20 is used to support the material being thermally treated and to separate the work zone from the heating element 22. The graphite retort 20 also distributes heat created by the heating element 22 and improves work zone 50 temperature uniformity.

High temperature graphite insulation is suitable for use to 3000° K and can be used to fully insulate the furnace if desired. In FIG. 1, high temperature graphite insulation is surrounded by lower temperature insulation to reduce fabrication costs. The lower temperature insulation can be either a readily available ceramic fiber insulator rated to 1500° K or a low temperature carbon insulation with similar temperature capabilities. The combined thickness of the high temperature insulation 18 and the low temperature insulation 16 should be approximately the same on the top, bottom, and sides in order to maintain temperature uniformity within the work zone 50.

Temperature gradients within the work zone 50 are created by unequal heat flows through the different sides of the zone. In the ideal case of perfect insulation there would be no heat flows through the insulation and the work zone 50 would be isothermal. In actual furnaces, reducing the magnitude of the heat flows through the insulation, either by increasing the efficiency of the insulation or by eliminating water cooling, will result in a decrease in the magnitude of the temperature gradients within the work zone 50. Eliminating chamber water cooling results in a profound reduction in heat flow through the insulation because of the vast difference in heat transfer coefficient for heat transfer from the chamber to flowing water as compared to the heat transfer coefficient for heat transfer from the chamber to ambient air.

In operation, air is evacuated from the vessel through vacuum port 52 and electrical currents are passed through the power feedthroughs 34 to the power buss rods 24 and thence to the heating element 22. The heating element 22 is designed to have a higher total resistance than the power buss rods 24 so that most of the heat is generated within the work zone 50. After thermal equilibrium is reached, all of the heat generated by the heating element 22 passes through the thermal insulation or through insulation penetrations for accessories such as the sight window assembly 32 and the power buss rods 24. Most of this heat is eventually transferred to the vacuum vessel components comprised of the chamber sidewall 10, bottom plate 12, and top door 26. These components will rise in temperature until the heat output of the heating element 22 is matched by the heat losses of the vacuum vessel components to the outside air. At this point the temperature of the vacuum chamber will stabilize and rise no more.

The chamber sidewall 10, bottom plate 12, and top door 26, transfer heat to the ambient air in the room by a combination of radiation and convection losses. Those skilled in the art of heat transfer calculations can readily determine the amount of these heat losses for any given combination of chamber sidewall 10 surface area, bottom plate 12 surface area, top door 26 surface area, material emmissivity, ambient air temperature, ambient air velocity, and vessel temperature.

The vacuum furnace shown in FIG. 1 will not require water cooling if the chamber and hence the chamber surface area is made large enough so that total heat losses match element heat generation before the vessel temperature reaches 500° K–600° K as described earlier. For any size work zone 50 a chamber can be designed which has enough surface area to dissipate all heat generated before this 500° K–600° K limit is reached. In the example shown in FIG. 1, a work zone 100 mm in diameter by 50 mm tall surrounded by 50 mm of high temperature insulation and 100 mm of low temperature insulation reached 2500° K with 1 kW of power input. A 400 mm diameter by 425 mm tall aluminum vacuum vessel had sufficient surface area to radiate and convect this 1 kW of power to the ambient 300° K air when at a maximum vessel temperature of 400° K.

Accordingly, the reader will see that the high temperature air cooled vacuum furnace of this invention is a significant improvement over the prior art which required water cooling of the vacuum vessel. Water cooling used in the prior art was very effective in removing large amounts of heat from the furnace, which in turn required much greater heat generation from the heating element to compensate. The elimination of water cooling reduces overall furnace heat losses dramatically, thereby allowing the furnace to reach temperature with far less power consumption. This yields significant simplification of virtually all furnace subsystems including: vacuum chamber (from double wall to single wall); chamber door (from double wall to single wall); water system (eliminated); power supply (now much smaller); power cables (now much smaller); and power controller (now much smaller).

Although the description above contains many specificities, these should not be construed as limiting the scope of the invention but merely providing illustrations of some of the preferred embodiments of this invention. For example, thermal insulation other than graphite fibrous insulation could be used to insulate the work zone, including ceramic insulation and refractory metal radiation shields. The vacuum chamber can be made from a wide range of acceptable materials other than aluminum, and work zone sizes ranging from laboratory scale to full production size can be made. Heat removal can be enhanced by means of fan cooling added to the outside of the chamber. Similarly, the chamber surface area may be increased by adding corrugations, fins, or some other area enhancing means. Also, the chamber surface may be altered to change its emmissivity, thereby altering its ability to radiate thermal energy.

Thus the scope of the invention should be determined by the appended claims and their legal equivalents, rather than by the examples given.

I claim:

1. A high temperature air cooled vacuum furnace for operation above 1500° K comprising:

a vacuum vessel having an exterior surface area exposed to ambient air;

a work zone hermetically sealed from said ambient air and defined by a high temperature insulation within said vacuum vessel;

an internal electrically powered heating element operatively positioned in heating relation to said work zone;

said heating element and said work zone being surrounded by said high temperature insulation comprising fibrous graphite insulation contiguous with said work zone for controlling heat losses from said work zone;

said vacuum vessel having said high temperature insulation and a total said vessel exterior surface area sufficient to transfer all of the heat generated by said heating element to the ambient air by convection of radiation while maintaining said exterior surface area of said vacuum vessel at a temperature of less than about 500° K, wherein said furnace can safely operate without cooling water and with reduced power consumption as compared to a water cooled furnace.

2. The high temperature air cooled vacuum furnace of claim 1 wherein said furnace is a small laboratory size system which operates with about 1 kW of power.

3. The high temperature air cooled vacuum furnace of claim 1 wherein said high temperature fibrous graphite insulation is substantially surrounded by low temperature insulation.

* * * * *